US009873148B2

(12) United States Patent
Park et al.

(10) Patent No.: US 9,873,148 B2
(45) Date of Patent: Jan. 23, 2018

(54) FRAME FOR SELF-PIERCING RIVET SYSTEM

(71) Applicant: SUNGWOO HITECH CO., LTD., Busan (KR)

(72) Inventors: Byung Joon Park, Yangsan-si (KR); Mun Yong Lee, Busan (KR); Tae Young Kang, Gwangju-si (KR); Do Hyung Kim, Gwangju-si (KR); Sung Ho Lee, Gwangju-si (KR)

(73) Assignee: SUNGWOO HITECH CO., LTD., Busan (KR)

( * ) Notice: Subject to any disclaimer, the term of this patent is extended or adjusted under 35 U.S.C. 154(b) by 311 days.

(21) Appl. No.: 14/585,332

(22) Filed: Dec. 30, 2014

(65) Prior Publication Data

US 2016/0167111 A1 Jun. 16, 2016

(30) Foreign Application Priority Data

Dec. 12, 2014 (KR) ..... 10-2014-0179671

(51) Int. Cl.
*B21J 15/02* (2006.01)
*B21J 15/10* (2006.01)

(52) U.S. Cl.
CPC ..... *B21J 15/025* (2013.01); *B21J 15/10* (2013.01)

(58) Field of Classification Search
CPC ..... B21J 15/025; B21J 15/10; B21J 15/30
(Continued)

(56) References Cited

U.S. PATENT DOCUMENTS 1,662,856 A * 3/1928 Hanna ..... B21J 15/30 72/447
1,833,216 A * 11/1931 Hanna ..... B21J 15/18 192/109 R (Continued)

FOREIGN PATENT DOCUMENTS

CN 201579364 9/2010
DE 19905527 8/2000

(Continued)

*Primary Examiner* — Nathaniel Chukwurah
(74) *Attorney, Agent, or Firm* — Lex IP Meister, PLLC

(57) ABSTRACT

A frame for a self-piercing rivet system that can provide bearing capacity for joining a rivet to a plate by using an anvil die and a punch unit is disclosed. An exemplary embodiment of the present invention provides a frame for a self-piercing rivet system provided with a punch unit on an upper portion thereof and an anvil unit on a lower portion thereof corresponding to the punch unit, that may include: an outer frame portion formed by connecting an inner semicircular body and an outer semicircular body which has a different radius and a central position from the inner semicircular body by a plurality of ribs; an inner frame portion formed by connecting both ends of a bending body to both ends of the inner semicircular body at the inside of the outer frame portion; an upper inner extender extended from an upper end of the inner frame portion; an upper outer extender extended from an upper end of the outer frame portion; a lower inner extender extended from a lower end of the inner frame portion; a lower outer extender extended from a lower end of the outer frame portion; a punch mounting end integrally formed at a front end of the upper inner extender and the upper outer extender; and an anvil mounting end integrally formed at a front end of the lower inner extender and the lower outer extender.

19 Claims, 5 Drawing Sheets

(58) Field of Classification Search
USPC ..... 227/112, 154; 29/465
See application file for complete search history.

(56) References Cited

U.S. PATENT DOCUMENTS

| | | | | |
|---|---|---|---|---|
| 2004/0060958 | A1* | 4/2004 | Kondo | B21J 15/025 227/51 |
| 2004/0261245 | A1* | 12/2004 | Naito | B21D 39/031 29/465 |
| 2006/0042349 | A1* | 3/2006 | Kernosky | B21J 15/025 72/470 |
| 2011/0016939 | A1* | 1/2011 | Clew | B21D 39/031 72/31.01 |
| 2013/0205574 | A1* | 8/2013 | Doo | B21J 15/025 29/524.1 |
| 2013/0263433 | A1* | 10/2013 | Stoian | B21J 15/02 29/525.06 |

FOREIGN PATENT DOCUMENTS

| | | |
|---|---|---|
| DE | 69911040 | 6/2004 |
| DE | 102013000387 | 7/2014 |
| EP | 1477249 | 11/2004 |
| JP | 2003-103338 | 4/2003 |
| KR | 10-2008-0110364 | 12/2008 |
| KR | 10-2014-0026817 | 3/2014 |
| KR | 10-1392965 | 4/2014 |

* cited by examiner

FRAME FOR SELF-PIERCING RIVET SYSTEM

CROSS-REFERENCE TO RELATED APPLICATION

This application claims priority to and the benefit of Korean Patent Application No. 10-2014-0179671 filed in the Korean Intellectual Property Office on Dec. 12, 2014, the entire contents of which are incorporated herein by reference.

BACKGROUND OF THE INVENTION (a) Field of the Invention

The present invention relates to a frame for a self-piercing rivet system. More particularly, the present invention relates to a frame for a self-piercing rivet system that can provide bearing capacity for joining a rivet to a plate by using an anvil die and a punch unit.

(b) Description of the Related Art

Automotive industries pay attention to environmental problems, and apply aluminum alloys and plastic materials to a vehicle body so as to reduce weight of the vehicle body and to improve fuel consumption as one of solutions that improves the environmental problems.

For this purpose, joining methods for assembling the vehicle body instead of using conventional spot welding have been researched and developed.

Recently, a self-piercing rivet using a self-piercing rivet system has been increasingly used.

According to a conventional riveting technique, joining objects such as steel sheets are joined by forming a head portion after a riveting hole is bored and a rivet is inserted into the riveting hole.

However, the rivet is press-fitted into the joining objects by hydraulic pressure or pneumatic pressure without forming the riveting hole according to the self-piercing rivet technique. At this time, the rivet is plastically deformed and joins the joining objects.

The self-piercing rivet system includes a C-shaped frame 101 mounted on a front end of an arm of a robot (not shown), a punch unit 103 formed at an upper portion of the frame 101, and an anvil unit 105 formed at a lower portion of the frame 101 corresponding to the punch unit 103, as shown in FIG. 1.

Further, the punch unit 103 includes a punch cylinder 111 and a punch housing 113, and is mounted on the frame 101 through the punch housing 113. The punch housing 113 includes a punch (not shown) operated by an operating rod of the punch cylinder 111 and a clamper 115 inside thereof.

The anvil unit 105 includes an anvil die 117, and is mounted on a lower portion of the frame 101 through a mounting rod.

The self-piercing rivet system as described above performs self-piercing riveting by operating the robot through the frame 101 mounted on the arm of the robot (not shown).

Herein, an operation force of the punch unit 103 is transmitted to a lower portion of the conventional C-shape frame 101 near to the anvil unit 105, so a large load is applied to the conventional frame 101. Thus, the conventional frame 101 should be made of steel materials in order to maintain rigidity and bear the load.

However, the conventional frame can become heavier since it is made of steel materials. Accordingly, more power for operating the robot may be required, and operation responsiveness of the robot may be decreased.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a frame for a self-piercing rivet system having advantages of excellent structural rigidity and light weight by being formed with an outer frame portion and an inner frame portion.

In addition, an exemplary embodiment of the present invention provides a frame for a self-piercing rivet system that may prevent asymmetric load occurrence and distribute stress through the stress distributor.

An exemplary embodiment of the present invention provides a frame for a self-piercing rivet system provided with a punch unit on an upper portion thereof and an anvil unit on a lower portion thereof corresponding to the punch unit, that may include: an outer frame portion formed by connecting an inner semicircular body and an outer semicircular body which has a different radius and a central position from the inner semicircular body by a plurality of ribs; an inner frame portion formed by connecting both ends of a bending body to both ends of the inner semicircular body at the inside of the outer frame portion; an upper inner extender extended from an upper end of the inner frame portion; an upper outer extender extended from an upper end of the outer frame portion; a lower inner extender extended from a lower end of the inner frame portion; a lower outer extender extended from a lower end of the outer frame portion; a punch mounting end integrally formed at a front end of the upper inner extender and the upper outer extender; and an anvil mounting end integrally formed at a front end of the lower inner extender and the lower outer extender.

The frame may further include a stress distributor distributing stress applied to the punch mounting end and the anvil mounting end by being formed with at least one curved groove on an external circumferential surface of the upper outer extender and the lower outer extender.

The outer frame portion may include: an inner semicircular body having a constant radius; an outer semicircular body having a larger radius than the inner semicircular body, disposed outside of the inner semicircular body by arranging a center thereof on a horizontal center line adjacent to a center of the inner semicircular body, and connecting an upper end and a lower end thereof with an upper end and a lower end of the inner semicircular body through each connecting end; and a plurality of ribs forming a plurality of closed spaces between the inner semicircular body and the outer semicircular body by connecting an external circumferential surface of the inner semicircular body and an interior circumferential surface of the outer semicircular body.

The plurality of closed spaces may be formed with the same number in a upper portion and a lower portion with reference to the horizontal center line, and two closed spaces divided by the inner semicircular body, the outer semicircular body, each connecting end, and the rib have a barrier at the center in a thickness direction inside thereof.

A width between the inner semicircular body and the outer semicircular body may taper when receding from the horizontal center line.

The upper outer extender and the lower outer extender may be extended from an upper end and a lower end of the outer semicircular body along a same radius of the outer semicircular body.

The inner frame portion may include: a vertical portion of which the bending body is formed in a vertical direction corresponding to an interior circumferential surface of the inner semicircular body; and an upper curved end and a lower curved end connected to both ends of the inner semicircular body by being bent and extended upwards and downwards from the vertical portion along the interior circumferential surface of the inner semicircular body.

The bending body may have a barrier formed at the center in a thickness direction between the inner semicircular body and the bending body, and the upper inner extender and the lower inner extender are extended from the upper curved end and the lower curved end of the bending body in parallel with the horizontal center line.

The upper inner extender and the upper outer extender may form a closed space by being connected to the punch mounting end, the inner frame portion, and the outer frame portion.

The lower inner extender and the lower outer extender may form a closed space by being connected to the anvil mounting end, the inner frame portion, and the outer frame portion.

The outer frame portion may be formed with a plurality of mounting holes in a thickness direction of the outer semicircular body.

An exemplary embodiment of the present invention may be formed with an outer frame portion formed with a C-shape by connecting an inner semicircular body and an outer semicircular body which has a different radius and a central position from the inner semicircular body by a plurality of ribs and an inner frame portion formed by connecting both ends of a bending body to both ends of the inner semicircular body at the inside of the outer frame portion, so it may have a light weight and excellent structural rigidity because of structural stability.

In addition, the frame for a self-piercing rivet system according to an exemplary embodiment of the present invention may be formed with the punch mounting end, the anvil mounting end, and the stress distributor, so it may prevent asymmetric load occurrence and distribute stress concentrated on the punch mounting end and the anvil mounting end through the stress distributor.

Accordingly, the frame for a self-piercing rivet system according to an exemplary embodiment of the present invention can secure structural rigidity even though it has a light weight, so power for operating the robot can be decreased and operation responsiveness of the robot can be increased.

DETAILED DESCRIPTION OF THE EMBODIMENTS

Figure 1:
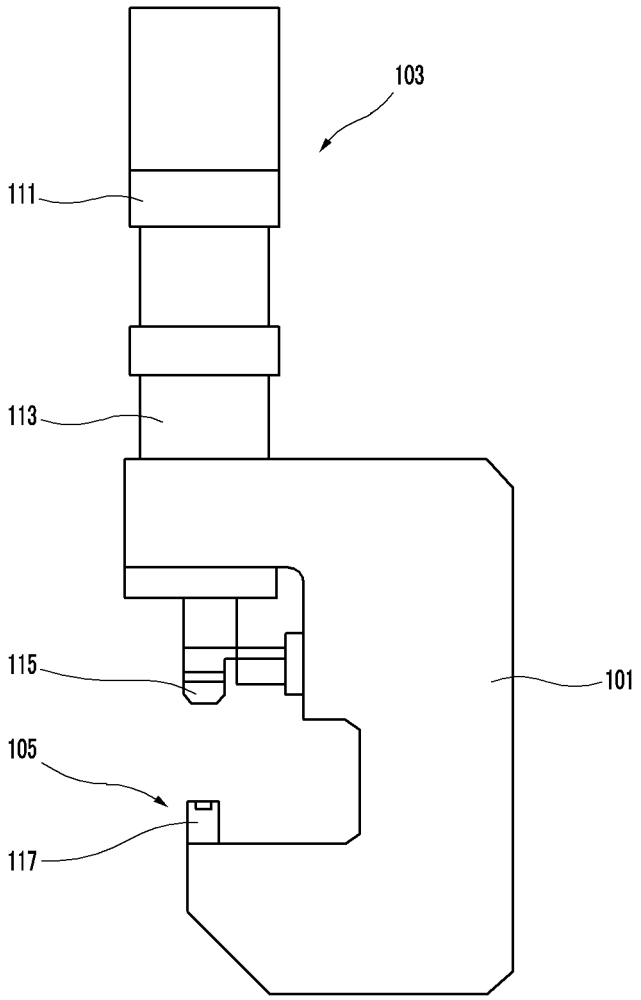
FIG. 1 (Prior Art )
FIG. 1 is a schematic side view of a conventional self-piercing rivet system.

An exemplary embodiment of the present invention will hereinafter be described in detail with reference to the accompanying drawings.

Size and thickness of components shown in the drawings may differ from actual size and actual thickness of the components for better comprehension and ease of description, and thickness of some portions and regions are drawn with an enlarged scale. In addition, description of components which are not necessary for explaining the present invention will be omitted.

Figure 3:
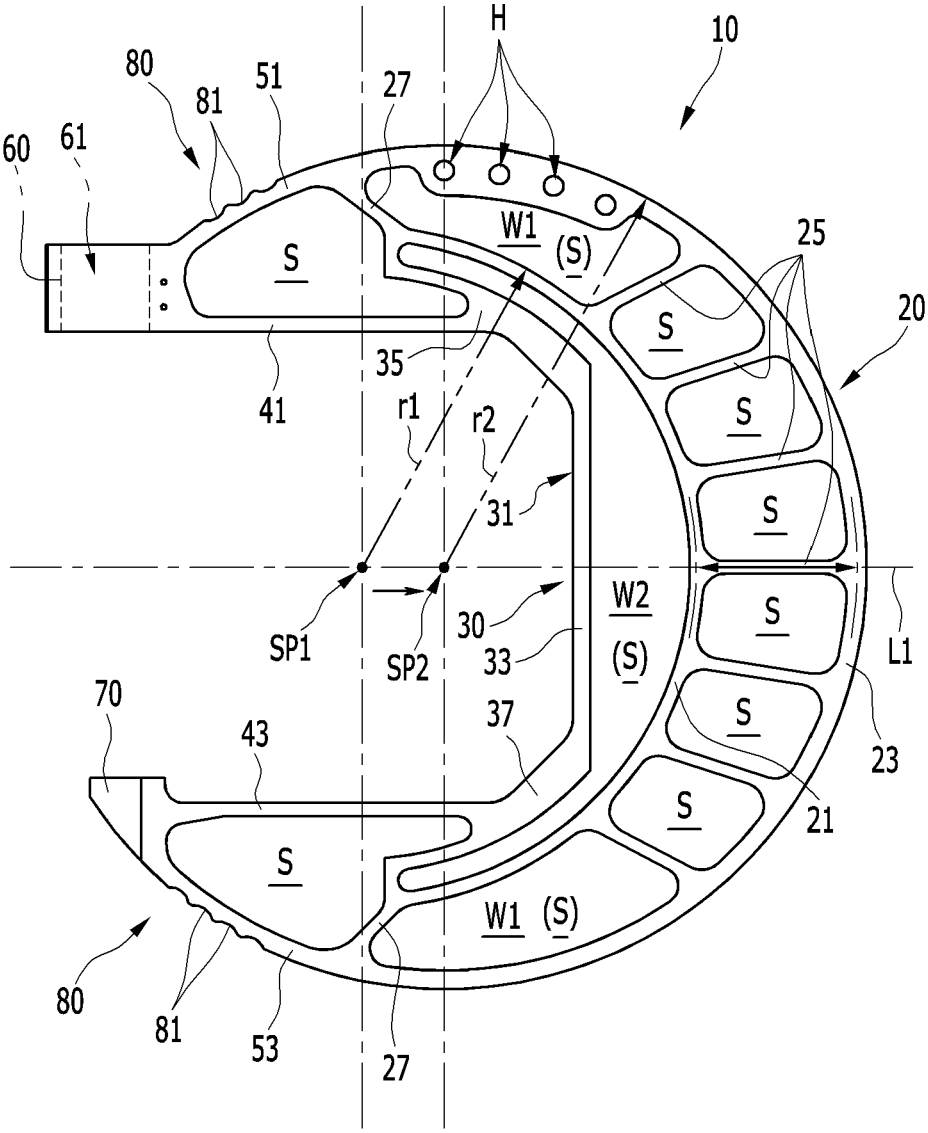
FIG. 3 is a side view of a frame for a self-piercing rivet system according to an exemplary embodiment of the present invention.

In the description of an exemplary embodiment of the present invention, the left is defined as 'forward' and the right is defined as 'rearward' in FIG. 3 for the convenience of description.

Figure 2:
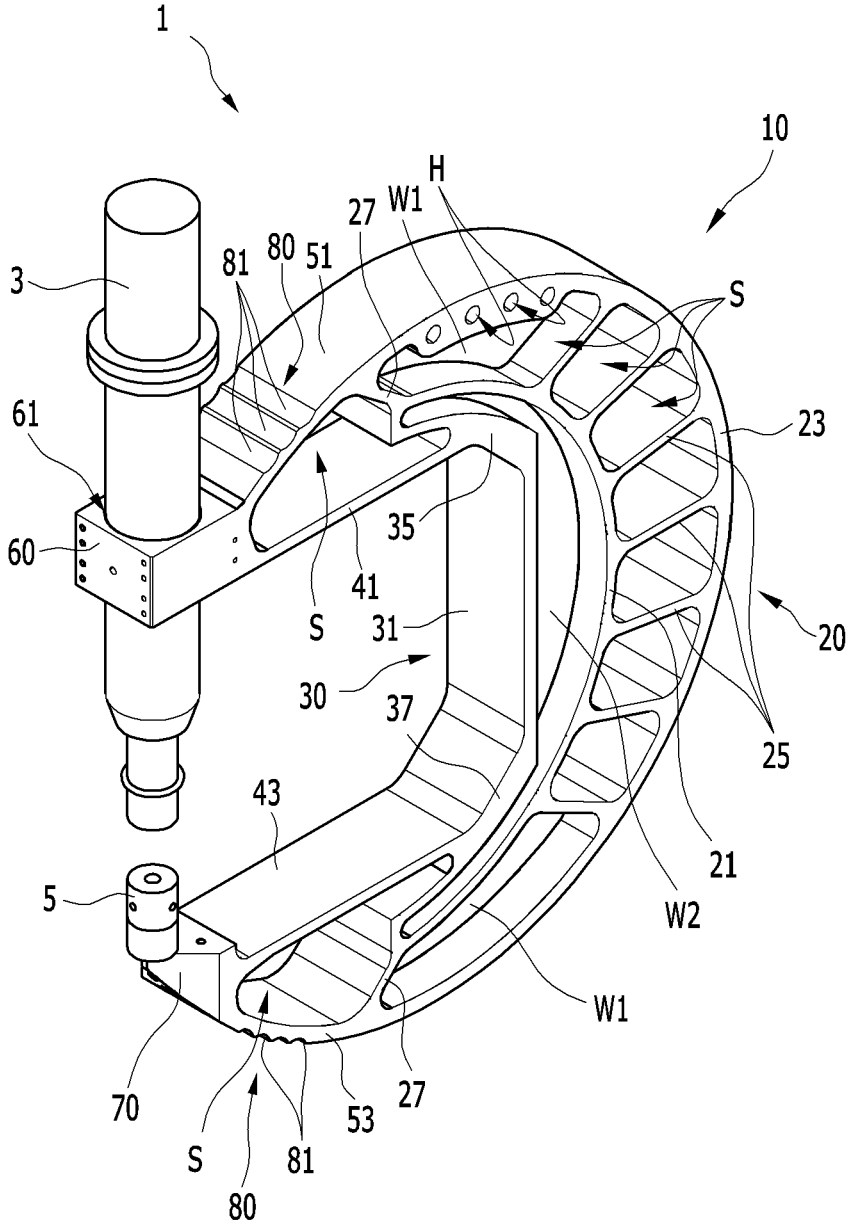
FIG. 2 is a perspective view of a self-piercing rivet system to which a frame for a self-piercing rivet system according to an exemplary embodiment of the present invention is applied.

FIG. 2 is a perspective view of a self-piercing rivet system to which a frame for a self-piercing rivet system according to an exemplary embodiment of the present invention is applied.

Referring to FIG. 2, a self-piercing rivet system 1 to which a frame 10 according to an exemplary embodiment of the present invention applied is formed as a C-shape, and includes a punch unit 3 mounted at a front end of an upper portion thereof and an anvil unit 5 mounted at a front end of a lower portion thereof corresponding to the punch unit 3.

That is, a frame 10 for a self-piercing rivet system may be formed as a C-shape with the punch unit 3 and the anvil unit 5 facing each other. The frame 10 for a self-piercing rivet system basically includes an outer frame portion 20 and an inner frame portion 30, and further includes an upper inner extender 41, an upper outer extender 51, a lower inner extender 43, a lower outer extender 53, a punch mounting end 60, an anvil mounting end 70, and a stress distributor 80.

Hereinafter, a detailed configuration of the frame for a self-piercing rivet system according to an exemplary embodiment of the present invention will be described with reference to FIG. 3 to FIG. 5.

Figure 4:
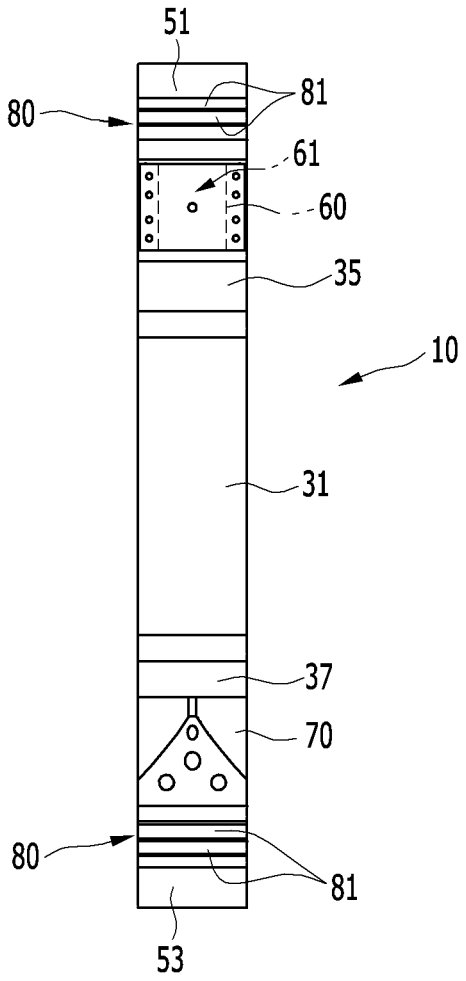
FIG. 4 is a front view of a frame for a self-piercing rivet system according to an exemplary embodiment of the present invention.
Figure 5:
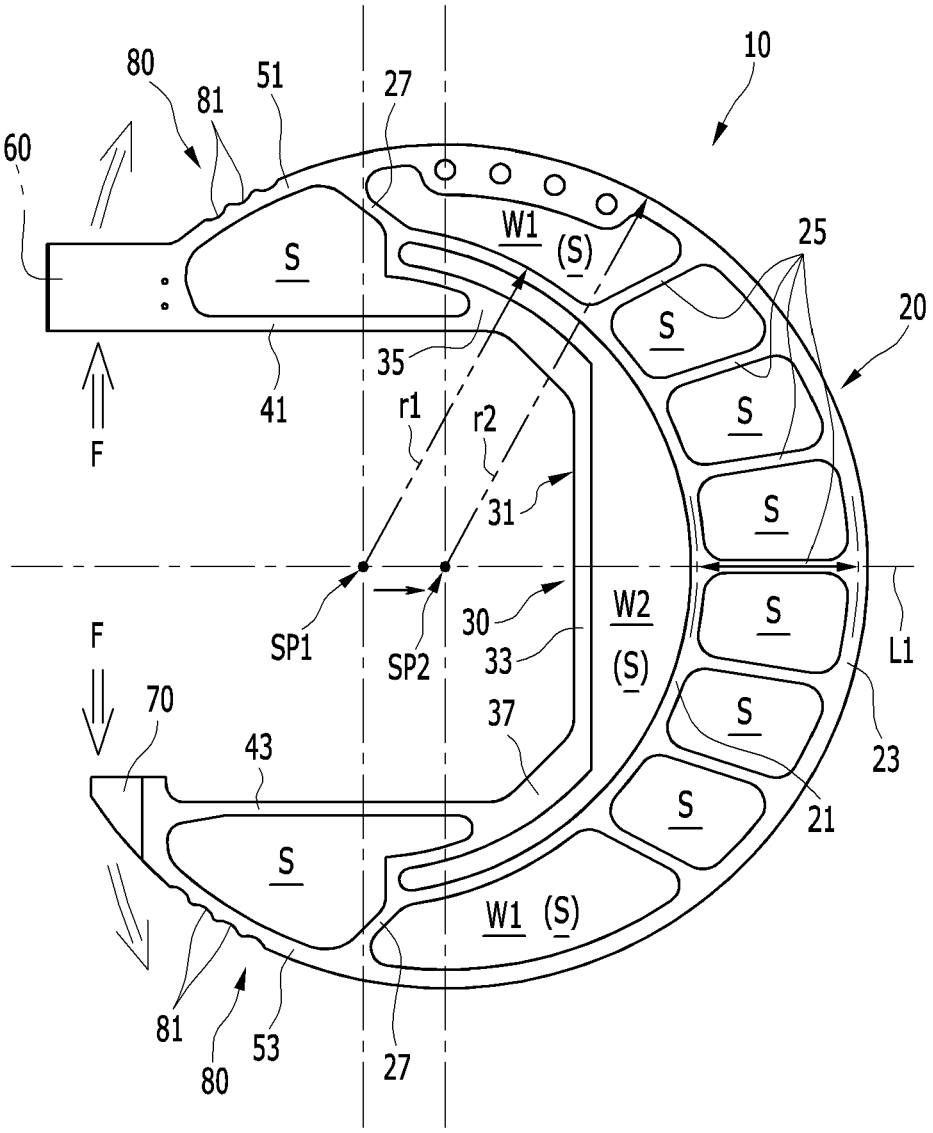
FIG. 5 is a diagram for explaining a frame for a self-piercing rivet system according to an exemplary embodiment of the present invention.

FIG. 3 is a side view of a frame for a self-piercing rivet system according to an exemplary embodiment of the present invention, FIG. 4 is a front view of a frame for a self-piercing rivet system according to an exemplary embodiment of the present invention, and FIG. 5 is a diagram for explaining a frame for a self-piercing rivet system according to an exemplary embodiment of the present invention.

The outer frame portion 20 is formed by connecting an inner semicircular body 21 and an outer semicircular body 23 by a plurality of ribs 25. The inner semicircular body 21 which has a radius r1 and the outer semicircular body 23 which has a radius r2 are disposed on a horizontal center line L1, and a center position of the inner semicircular body SP1 is adjacent to a center position of the outer semicircular body SP2.

That is, the outer frame portion 20 includes the inner semicircular body 21 which has a radius r1 and the outer semicircular body 23 which has a radius r2 that is larger than the radius r1.

The outer semicircular body 23 is disposed outside of the inner semicircular body 21. In other words, the center position of the outer semicircular body SP2 is disposed rearward of the center position of the inner semicircular body SP1 on the horizontal center line L1. An upper end and a lower end of the outer semicircular body 23 are connected to an upper end and a lower end of the inner semicircular body 21 through connecting ends 27.

Herein, a width G between the inner semicircular body 21 and the outer semicircular body 23 tapers while receding from the horizontal center line L1.

In addition, the rib 25 forms a plurality of closed spaces S between the inner semicircular body 21 and the outer semicircular body 23 by connecting an external circumferential surface of the inner semicircular body 21 and an interior circumference of the outer semicircular body 23.

Herein, two closed spaces divided by the inner semicircular body 21, the outer semicircular body 23, each connecting end 27, and the rib 25 are formed with a barrier W1 at the center in a thickness direction inside thereof.

In the exemplary embodiment of the present invention, eight closed spaces S and two barriers W1 are formed by seven ribs 25 and two connecting ends 27, but it is not limited thereto. The number of closed spaces S may be adjusted by the number of ribs.

Moreover, the plurality of closed spaces S may be formed with the same numbers in an upper portion and a lower portion with reference to the horizontal center line L1.

The outer frame portion 20 is formed with four mounting holes H in a thickness direction of the outer semicircular body 23. Thus, the frame 1 may be mounted at an arm of a robot (not shown).

The inner frame portion 30 is formed by connecting both ends of a bending body 31 to both ends of the inner semicircular body 21 at the inside of the outer frame portion 20.

That is, the inner frame portion 30 includes a vertical portion 33 of which the bending body is formed in a vertical direction corresponding to an interior circumferential surface of the inner semicircular body 31, an upper curved end 35 connected to an upper end of the inner semicircular body 21 by being bent and extended upwards from the vertical portion 33, and a lower curved end 37 connected to a lower end of the inner semicircular body 21 by being bent and extended downwards from the vertical portion 33.

Herein, the bending body 31 is formed with a barrier W2 at the center in a thickness direction between the inner semicircular body 21 and the bending body 31, and is connected to the inner semicircular body 21 through the barrier W2.

The upper inner extender 41 and the upper outer extender 51 are extended from an upper ends of the inner frame portion 30 and the outer frame portion 20. Also, the lower inner extender 43 and the lower outer extender 53 are extended from lower ends of the inner frame portion 30 and the outer frame portion 20.

That is, the upper outer extender 51 and the lower outer extender 53 are extended from the upper end and lower ends of the outer semicircular body 23 along a same radius as the radius r2 of the outer semicircular body 23.

In addition, the upper inner extender 41 and the lower inner extender 43 are extended from the upper curved end 35 and the lower curved end 37 of the bending body 31 in parallel with the horizontal center line L1.

Herein, the upper inner extender 41 and the upper outer extender 51 may form the closed space S by being connected to the punch mounting end 60, the inner frame portion 30, and the outer frame portion 20. Also, the lower inner extender 43 and the lower outer extender 53 may form the closed space S by being connected to the anvil mounting end 70, the inner frame portion 30, and the outer frame portion 20.

The punch mounting end 60 is integrally formed at a front end of the upper inner extender 41 and the upper outer extender 51 with a square block shape. Moreover, the punch mounting end 60 includes a mounting hole 61 in a vertical direction to mount the punch unit 3.

The anvil mounting end 70 is integrally formed at a front end of the lower inner extender 43 and the lower outer extender 53 with a sharp block shape to mount the anvil unit 5 on an upper surface thereof.

The stress distributor 80 is formed with at least one curved groove 81 on an external circumferential surface of the upper outer extender 51 and the lower outer extender 53.

Referring to FIG. 5, the curved groove 81 may distribute stress applied to the punch mounting end 60 and the anvil mounting end 70 when a flexural load F is applied by an operation of the self-piercing system to the frame 10 in a direction in which the frame 10 widens.

The stress distributor 80 is formed with three or four curved grooves 81 that form a waveform.

In the exemplary embodiment of the present invention, the stress distributor 80 may be formed with three curved grooves 81 on the upper outer extender 51 and four curved grooves 81 on the lower outer extender 53, but it is not limited thereto.

The number of curved grooves 81 may be determined by stress distribution through a test or a simulation. That is, the number of curved grooves 81 may be determined to prevent asymmetric load occurrence of the self-piercing rivet system according to the flexural load F when the punch unit 3 is operated.

According to an exemplary embodiment of the present invention as described above, the frame 10 for the self-piercing rivet system is formed with an outer frame and an inner frame by using the outer semicircular body 23 and the inner semicircular body 21, so it has excellent structural rigidity even though it has a light weight.

If the center position of the inner semicircular body SP1 is the same as the center position of the outer semicircular body SP2, an asymmetric load may occur to the self-piercing rivet system because stress is concentrated on the anvil mounting end 70.

However, if the center position of the outer semicircular body SP2 is disposed rearward of the center position of the inner semicircular body SP1 according to an exemplary embodiment of the present invention, structural rigidity may be secured because a plurality of ribs 25 connecting the inner semicircular body 21 and the outer semicircular body 23 may absorb the stress applied to the anvil mounting end 70.

In addition, the frame for a self-piercing rivet system 10 according to an exemplary embodiment of the present invention may prevent asymmetric load occurrence and distribute stress concentrated on the punch mounting end 60 and the anvil mounting end 70 through the stress distributor 80. Therefore, it is possible to prevent a defect of the self-piercing rivet system.

In addition, the frame for a self-piercing rivet system 10 according to an exemplary embodiment of the present invention has a light weight, so power for operating the robot can be decreased and operation responsiveness of the robot can be increased.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A frame for a self-piercing rivet system provided with a punch unit on an upper portion thereof and an anvil unit on a lower portion thereof corresponding to the punch unit, the frame comprising:

an outer frame portion formed by connecting an inner semicircular body and an outer semicircular body which has a different radius and a central position from the inner semicircular body by a plurality of ribs;

an inner frame portion formed by connecting both ends of a bending body to both ends of the inner semicircular body at the inside of the outer frame portion;

an upper inner extender extended from an upper end of the inner frame portion;

an upper outer extender extended from an upper end of the outer frame portion;

a lower inner extender extended from a lower end of the inner frame portion;

a lower outer extender extended from a lower end of the outer frame portion;

a punch mounting end integrally formed at a front end of the upper inner extender and the upper outer extender; and an anvil mounting end integrally formed at a front end of the lower inner extender and the lower outer extender.

2. The frame of claim 1, further comprising a stress distributor distributing stress applied to the punch mounting end and the anvil mounting end by being formed with at least one curved groove on an external circumferential surface of the upper outer extender and the lower outer extender.

3. The frame of claim 1, wherein the outer frame portion comprises:

an inner semicircular body having a constant radius;

an outer semicircular body having a larger radius than the inner semicircular body, disposed outside of the inner semicircular body by arranging a center thereof on a horizontal center line adjacent to a center of the inner semicircular body, and connecting an upper end and a lower end thereof with an upper end and a lower end of the inner semicircular body through each connecting end; and a plurality of ribs forming a plurality of closed spaces between the inner semicircular body and the outer semicircular body by connecting an external circumferential surface of the inner semicircular body and an interior circumferential surface of the outer semicircular body.

4. The frame of claim 3, wherein the plurality of closed spaces are formed with the same number in a upper portion and a lower portion with reference to the horizontal center line, and two closed spaces divided by the inner semicircular body, the outer semicircular body, each connecting end, and a rib have a barrier at the center in a thickness direction inside thereof.

5. The frame of claim 3, wherein a width between the inner semicircular body and the outer semicircular body tapers when receding from the horizontal center line.

6. The frame of claim 3, wherein the upper outer extender and the lower outer extender are extended from an upper end and a lower end of the outer semicircular body along a same radius of the outer semicircular body.

7. The frame of claim 1, wherein the inner frame portion comprises a vertical portion of which the bending body is formed in a vertical direction corresponding to an interior circumferential surface of the inner semicircular body; and an upper curved end and a lower curved end connected to both ends of the inner semicircular body by being bent and extended upwards and downwards from the vertical portion along the interior circumferential surface of the inner semicircular body.

8. The frame of claim 7, wherein the bending body has a barrier formed at the center in a thickness direction between the inner semicircular body and the bending body, and the upper inner extender and the lower inner extender are extended from the upper curved end and the lower curved end of the bending body in parallel with the horizontal center line.

9. The frame of claim 1, wherein the upper inner extender and the upper outer extender form a closed space by being connected to the punch mounting end, the inner frame portion, and the outer frame portion.

10. The frame of claim 1, wherein the lower inner extender and the lower outer extender form a closed space by being connected to the anvil mounting end, the inner frame portion, and the outer frame portion.

11. The frame of claim 1, wherein the outer frame portion is formed with a plurality of mounting holes in a thickness direction of the outer semicircular body.

12. A frame for a self-piercing rivet system provided a punch unit on an upper portion thereof and an anvil unit on a lower portion thereof corresponding to the punch unit, the frame comprising:

an outer frame portion including an inner semicircular body having a constant radius, an outer semicircular body having a larger radius than the inner semicircular body, disposed outside of the inner semicircular body by arranging a center thereof on a horizontal center line adjacent to a center of the inner semicircular body, and connecting an upper end and a lower end thereof with an upper end and a lower end of the inner semicircular body through each connecting end, and a plurality of ribs forming a plurality of closed spaces between the inner semicircular body and the outer semicircular body by connecting an external circumferential surface of the inner semicircular body and an interior circumferential surface of the outer semicircular body;

an inner frame portion formed to be a bending body which includes a vertical portion formed in a vertical direction corresponding to an interior circumferential surface of the inner semicircular body and an upper curved end and a lower curved end connected to both ends of the inner semicircular body by being bent and extended upwards and downwards from the vertical portion along the interior circumferential surface of the inner semicircular body, and connected to the inner semicircular body through a barrier formed at the center in a thickness direction between the inner semicircular body and the bending body;

an upper inner extender extended from the upper curved end;

an upper outer extender extended from an upper end of the outer semicircular body;

a lower inner extender extended from the lower curved end;

a lower outer extender extended from a lower end of the outer semicircular body;

a punch mounting end integrally formed at a front end of the upper inner extender and the upper outer extender; and an anvil mounting end integrally formed at a front end of the lower inner extender and the lower outer extender.

13. The frame of claim 12, further comprising a stress distributor distributing stress applied to the punch mounting end and the anvil mounting end by being formed with at least one curved groove on an external circumferential surface of the upper outer extender and the lower outer extender.

14. The frame of claim 12, wherein the plurality of closed spaces are formed with the same number in a upper portion and a lower portion with reference to the horizontal center line, and two closed spaces divided by the inner semicircular body, the outer semicircular body, each connecting end, and a rib have a barrier at the center in a thickness direction inside thereof.

15. The frame of claim 12, wherein the upper outer extender and the lower outer extender are extended from an upper end and a lower end of the outer semicircular body along a same radius of the outer semicircular body.

16. The frame of claim 12, wherein the upper inner extender and the lower inner extender are extended from the upper curved end and the lower curved end of the bending body in parallel with the horizontal center line.

17. The frame of claim 12, wherein the upper inner extender and the upper outer extender form a closed space by being connected to the punch mounting end, the inner frame portion, and the outer frame portion.

18. The frame of claim 12, wherein the lower inner extender and the lower outer extender form a closed space by being connected to the anvil mounting end, the inner frame portion, and the outer frame portion.

19. The frame of claim 12, wherein the outer frame portion is formed with a plurality of mounting holes in a thickness direction of the outer semicircular body.

* * * * *